United States Patent [19]

Goldfarb

[11] Patent Number: 4,955,605

[45] Date of Patent: Sep. 11, 1990

[54] HOME BASKETBALL APPARATUS

[76] Inventor: Adolph E. Goldfarb, 1432 S. Eastwind Cir., Westlake Village, Calif. 91361

[21] Appl. No.: 308,648

[22] Filed: Feb. 9, 1989

[51] Int. Cl.[5] ..... A63B 63/08

[52] U.S. Cl. ..... 273/15 A; 193/25 R

[58] Field of Search ..... 273/1.5 A, 1.5 R, 375, 273/396, 397; 193/25 R

[56] References Cited

U.S. PATENT DOCUMENTS

| | | | |
|---|---|---|---|
| Re. 20,898 | 10/1938 | Schabinger | 273/1.5 R |
| 2,064,310 | 12/1936 | Marker | 273/375 |
| 2,307,958 | 1/1943 | Richardson | 273/375 X |
| 2,523,257 | 9/1950 | Firestone | 273/375 X |
| 2,534,067 | 12/1950 | Rubin | 273/1.5 R |
| 2,658,495 | 11/1953 | Elliott, Sr. | 273/1.5 R X |
| 4,054,194 | 10/1977 | Davis | 193/25 R X |
| 4,291,885 | 9/1981 | Cohen | 273/1.5 A X |
| 4,468,027 | 8/1984 | Pangburn | 273/1.5 R |
| 4,582,166 | 4/1986 | Baker | 193/25 R X |

FOREIGN PATENT DOCUMENTS 1319878 6/1987 U.S.S.R. ..... 273/1.5 A

OTHER PUBLICATIONS

Recreation Sports & Leisure, 10-1985, Return Chute.

*Primary Examiner*—Paul E. Shapiro

*Attorney, Agent, or Firm*—Ashen Martin Seldon Lippman & Scillieri

[57] ABSTRACT

An inexpensive home basketball shooting game apparatus comprising a basketball hoop for being releasably mounted atop a door, an elongated return net for extending from around and below the hoop area outwardly and downwardly to where its opposite end is constructed and arranged to be releasably mounted on the top of a chair back. The return net catches the basketball after it is shot and returns it to the shooter. A score-sensing unit is mounted beneath the hoop to sense when a basket is made and an electrical timer and score-keeping unti is releasably mountable at the chair to record, store and display information about the basketball shooting performance of a player or players. The apparatus cooperates with the door and chair to minimize the structure required and thus the cost.

16 Claims, 4 Drawing Sheets

FIG. 5
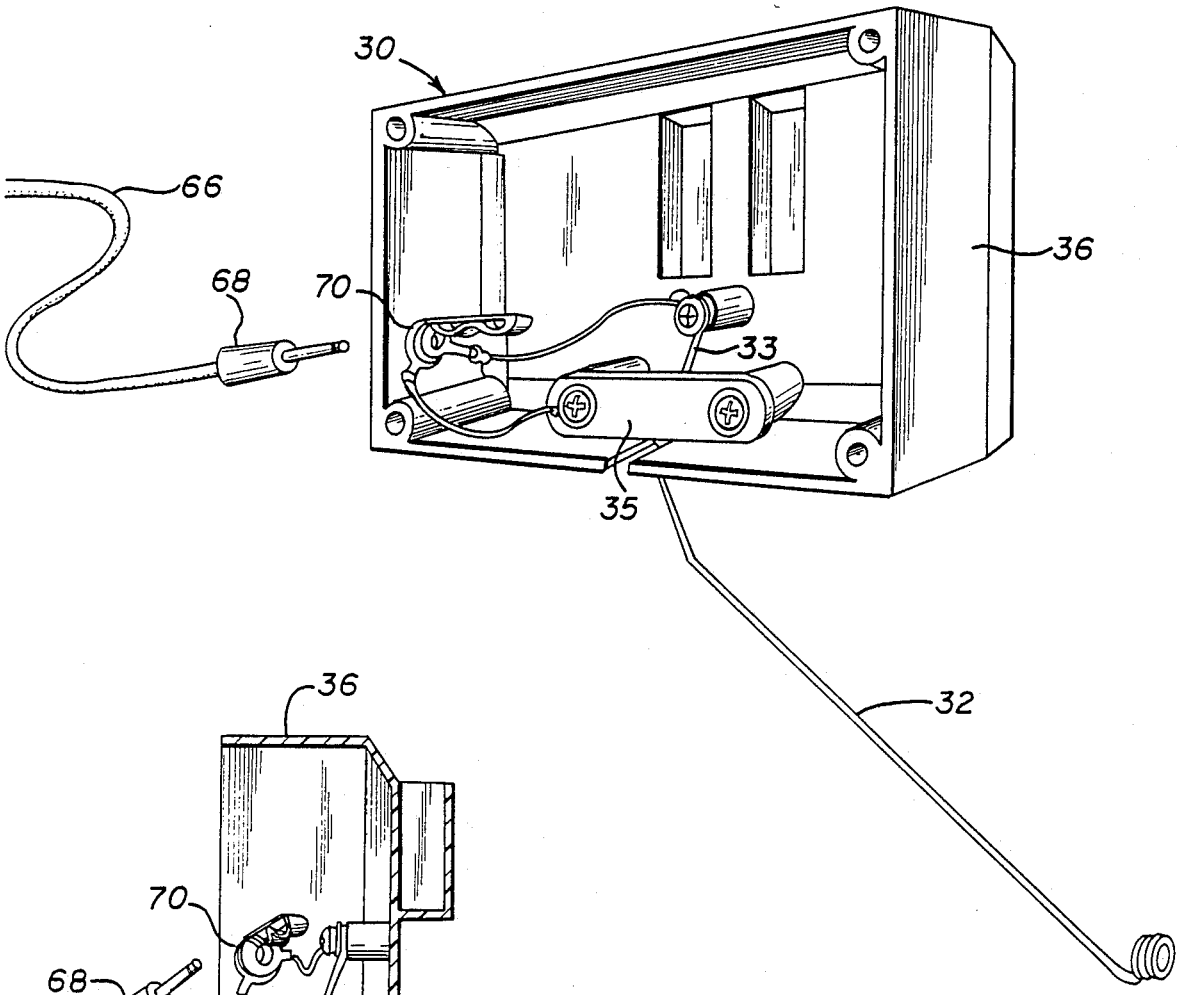
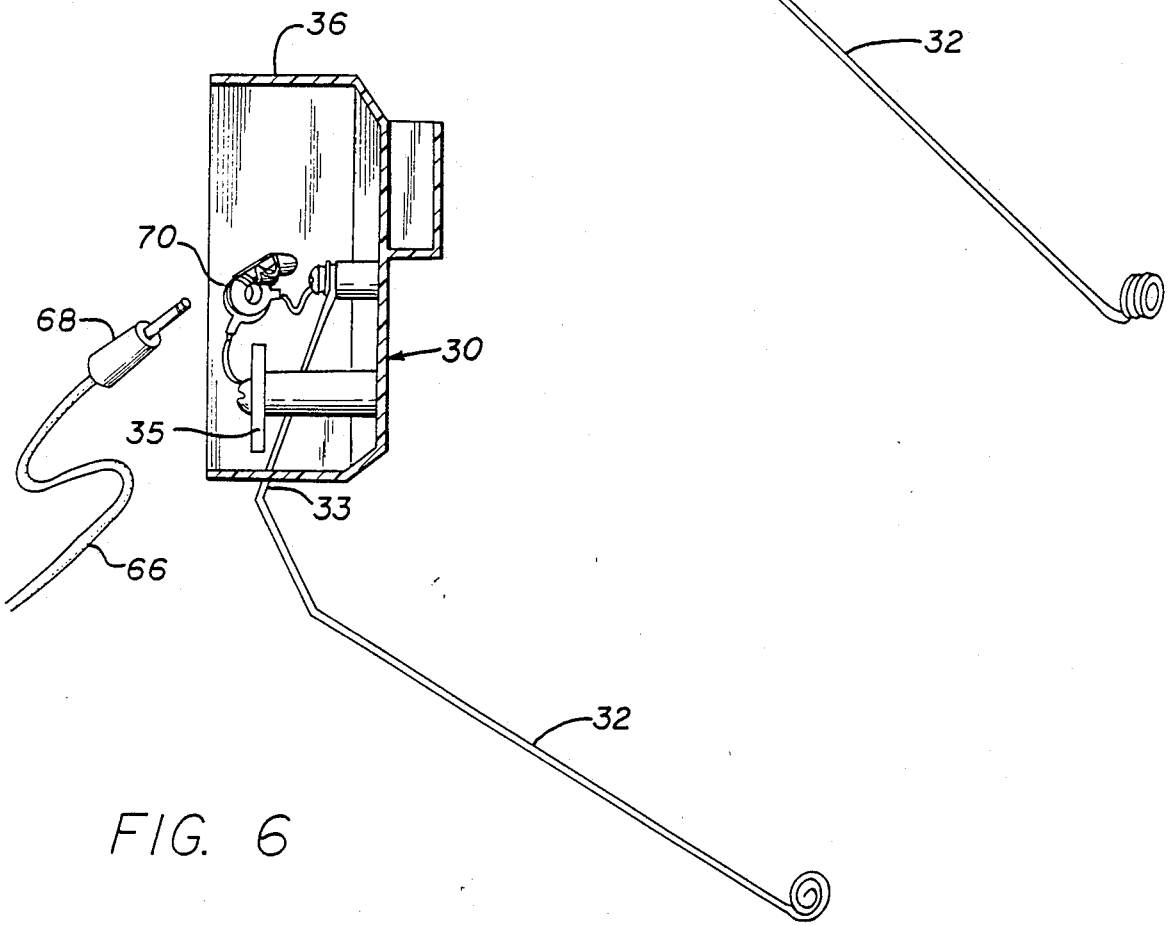
FIG. 6

HOME BASKETBALL APPARATUS

BACKGROUND OF INVENTION

Basketball games in arcades have become quite popular. They normally provide a basketball hoop which may be somewhat undersized, a plurality of balls which again may be undersized and somewhat different than regular basketballs, and a return net to catch the balls after the attempted shots and return them to the shooter. These basketball apparatus generally include sophisticated electronic equipment showing the number of shots taken, the number of baskets achieved, the time frame and various other factors such as the results of competition between one or more shooters. Such set-ups tend to be sophisticated, complicated and costly.

There have also been home basketball set-ups for inside the house which may be as simple as a miniature toy basketball hoop, net and backboard which can be hung on the wall or the like and one or more miniature basketballs for the younger child to practice shooting baskets.

SUMMARY OF DISCLOSURE

The illustrated home basketball playing apparatus provides, in a very inexpensive and simple form, many of the features provided by the sophisticated and expensive arcade games. The illustrated apparatus comprises a basketball hoop and a backboard which may be releasably supported at the upper edge of a household door. An elongated return net is provided. One upper end of the return net is supported so as to at least partially enclose the area around and below the basketball hoop. This end of the net is connected to a bracket that is releasably mounted on the doortop. The return net extends outwardly and downwardly; its second lower end is connected to a second bracket which is releasably mounted on the top of the seatback of a household chair. A score-sensing unit has an outwardly extending arm disposed below the basketball hoop so that when the basketball successfully passes through the hoop, the arm is engaged and a score is sensed. The scoring may involve the completion of an electrical circuit which sends a signal through a cable that extends along the net to a timer and display unit mounted at the chair. That timer/display unit may also keep track of and selectively display the number of baskets scored for each player and similar information.

The illustrated apparatus cooperates with a standard household door and an ordinary household chair to minimize the structure that must be provided by the apparatus itself. This in turn reduces substantially the cost of the apparatus relative to its size. Further, the illustrated apparatus lends itself to being readily and easily disassembled in a plurality of small easily handled and stored elements or subassemblies.

IN THE DRAWINGS

FIG. 5 is a further enlarged rear perspective view of the score sensing unit of FIG. 1, with the rear panel removed;

FIG. 6 is a side sectional view of the unit of FIG. 5;

DETAILED DESCRIPTION OF THE DRAWINGS

Figure 1:
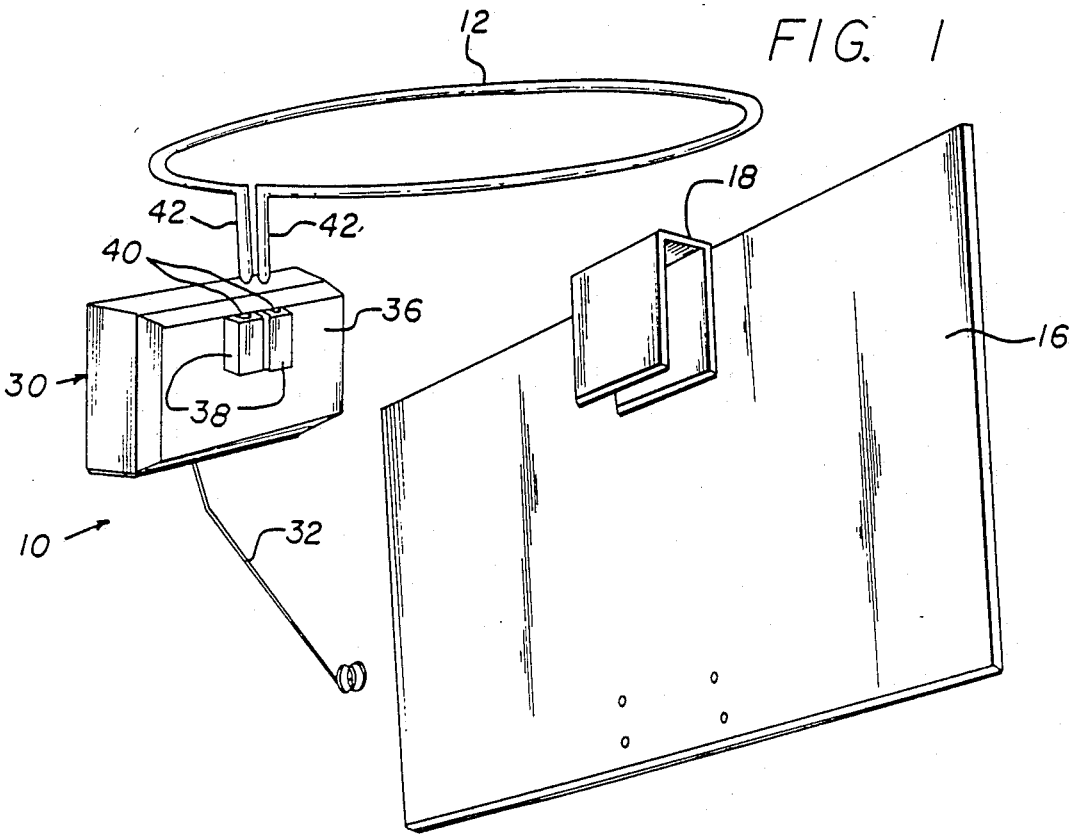
FIG. 1 is a schematic exploded perspective view of the basketball hoop, backboard, hanging bracket and score-sensing unit which embody elements of the invention.

A presently preferred embodiment of the invention is incorporated in the illustrated home basketball apparatus 10. As shown best in FIGS. 1 and 2, the illustrated apparatus 10 comprises generally a basketball hoop 12, a basket net 14, a backboard 16, and a bracket or hanging or connecting means 18 to releasably mount that portion of the apparatus to the upper edge of a household door D. The apparatus also includes a return net 20 which is elongated and connected at a first upper end 22 to a first connecting means 24 that releasably mounts to the top edge of the door. This positions the first upper end 22 of the return net so as to at least partially enclose the area around and below the basketball hoop 12. From there the assembled return net 20 extends outwardly and downwardly to a second lower end 26 which is connected to a second connecting means 28. The connecting means 28 releasably mounts the lower net end 26 to the top of the seatback of a household chair C. In addition, the apparatus 10 includes a basket-scoring sensor unit 30 which is mounted on the backboard. The unit 30 has a finger or element 32 that extends below the basketball hoop to be engaged each time a basket passes through the hoop. The score-sensing unit 30 is connected to an electrical cord 66 that passes along the return net 20 to a timer and display unit 34. The display unit 34 is mounted on the chair so it can be used and observed by the players.

Now to consider the illustrated structure 10 in further detail. The generally rectangular backboard 16 is secured to the bracket 18. That bracket 18 has a generally inverted U-shape, to permit it to be releasably hung over the top edge of the household door D to support the backboard. Mounted to the backboard 16 at its lower portion is the score-sensing unit 30. The unit 30 has a generally rectangular casing or housing 36. The arm or finger 32 is electrically conductive such as metal and extends downwardly and outwardly from the unit 30 as shown best in FIG. 6. When the basketball engages the finger 32, the finger is deflected downwardly and toward the door so that a section 33 engages an electrically conductive metal plate 35 to thereby close or complete an electrical circuit. This circuit includes the cord 66 and related portions of the display unit 34. A signal is thus provided to the unit 34 that a basket has been scored. The illustrated housing 36 has several extensions 38 on its forward face that define generally vertical slots 40 open at their upper ends. These slots 40 releasably receive vertically depending pin portions 42 of the hoop 12 (FIG. 1). In this manner, the basketball hoop 12 may be releasably mounted on the housing 36 and backboard 16 for use and then disassembled for easy storage.

Figure 2:
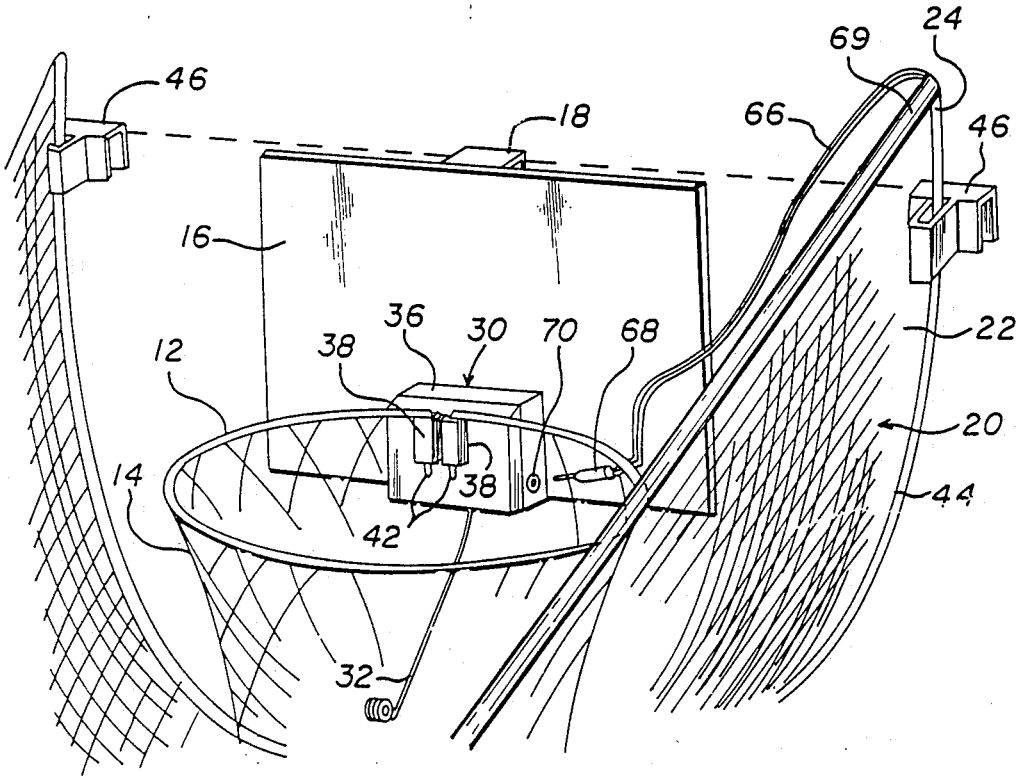
FIG. 2 is an enlarged schematic perspective view of the assembled hoop and backboard of FIG. 1 and the upper end of the return net.
Figure 3:
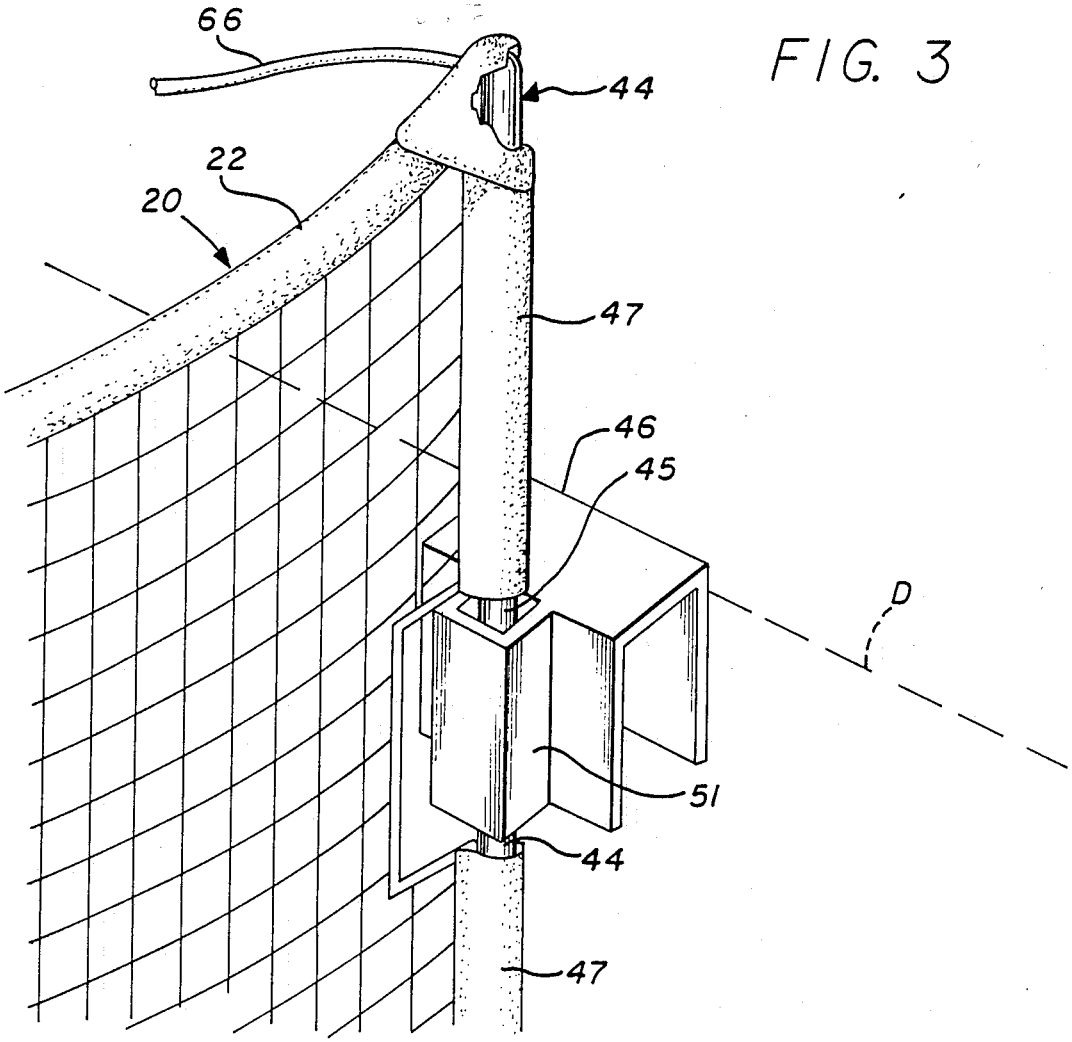
FIG. 3 is a further enlarged schematic perspective of one side portion of the upper end of the return net of FIG. 2.
Figure 4:
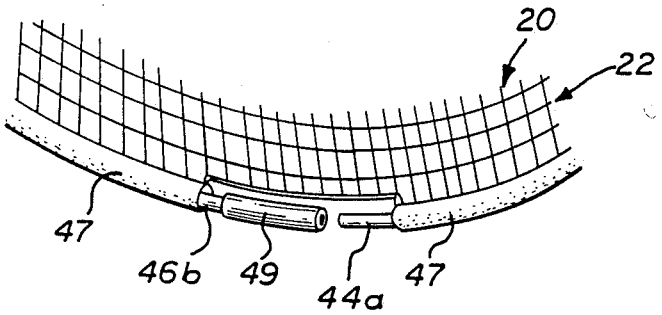
FIG. 4 is a fragmentary schematic perspective view of a mid-portion of the upper end of the return net of FIG. 2.

As shown in FIG. 2, the first connector 24 for the return net 20 is in the form of a generally U-shaped rod 44 which is connected at each of its legs 45 to a formed or molded bracket piece 46. Each of the bracket pieces 46 has an inverted generally U-shaped portion adapted to releasably clip or hang over the top edge of the door. The U-shaped rod 44 is thus releasably supported at the door top in close proximity to the door surface. This prevents the basketball from falling through space between the door and the return net upper end 22. The upper end 22 of the return net may be secured to this U-shaped rod 44 by any suitable means such as having edge strip portions or sections folded and then secured to themselves to define channels or sleeves 47 through which the rod extends. This is illustrated in FIGS. 3 and 4. More particularly, as shown in FIG. 4, the illustrated rod 44 may be formed from two half-sections **44*a* and 44*b* that may be releasably assembled together at the bottom center of the net end 22 as by a tubular sleeve connector 49. FIG. 4 illustrates the connector 49 attached to the end of rod section 44*b* and positioned to releasably receive and thereby connect to the end of rod section 44*a* to assemble the rod sections together. The net and net sleeves 47 are formed to expose the rod sections 44*a*, 44*b* and connector 49 to facilitate this assembly and disassembly. The disassembled rod sections 44*a* and 44*b* can be packaged, shipped and stored in a smaller space than would be required if the rod 44** were a single piece.

It also will be noted that the ends 45 of the rod 44 are supported so as to extend substantially above the door top. In this way the return net end 22 extends above the top of the backboard 16 and an even more substantial distance above the basketball hoop 12. This arrangement helps to catch and retain in the return net basketballs that strike the hoop and/or backboard and bounce upwardly and outwardly. As shown in FIG. 3, each bracket 46 engages the associated rod end 45 substantially below the upper extremity of that rod end. This positions that side of the net end 22 substantially above the door top, and even higher above the hoop. The net end 22 and its sleeves 47 are constructed to accommodate this arrangement. In particular, there is a space between sleeves 47 where the rod end 45 is connected to the bracket 46. Each rod end 45 extends through a vertical slot defined in an extension 51 provided at the forward face of the associated bracket 46.

As shown in the drawings, the return net 20 thus forms a generally arcuate or U-shaped trough that extends up around and beneath the basketball hoop area for catching the basketball after it is shot, whether the basketball passes through the hoop or bounces outwardly and/or upwardly from the hoop and/or backboard.

Figure 8:
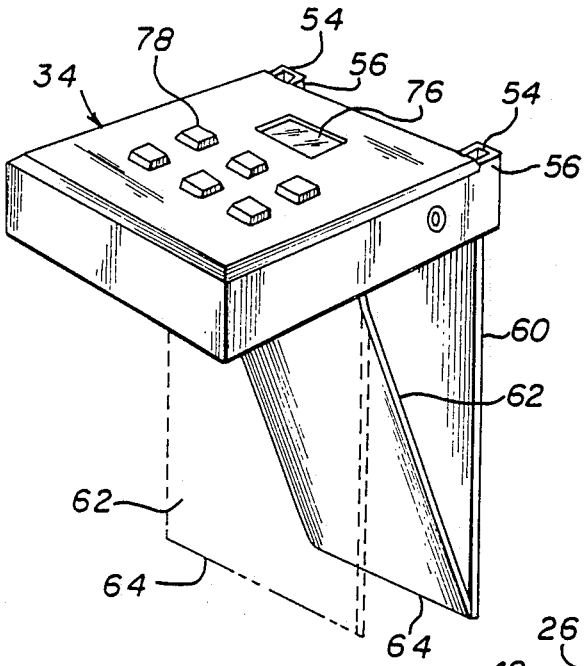
FIG. 8 is an enlarged perspective view of the display unit of FIG. 7.
Figure 7:
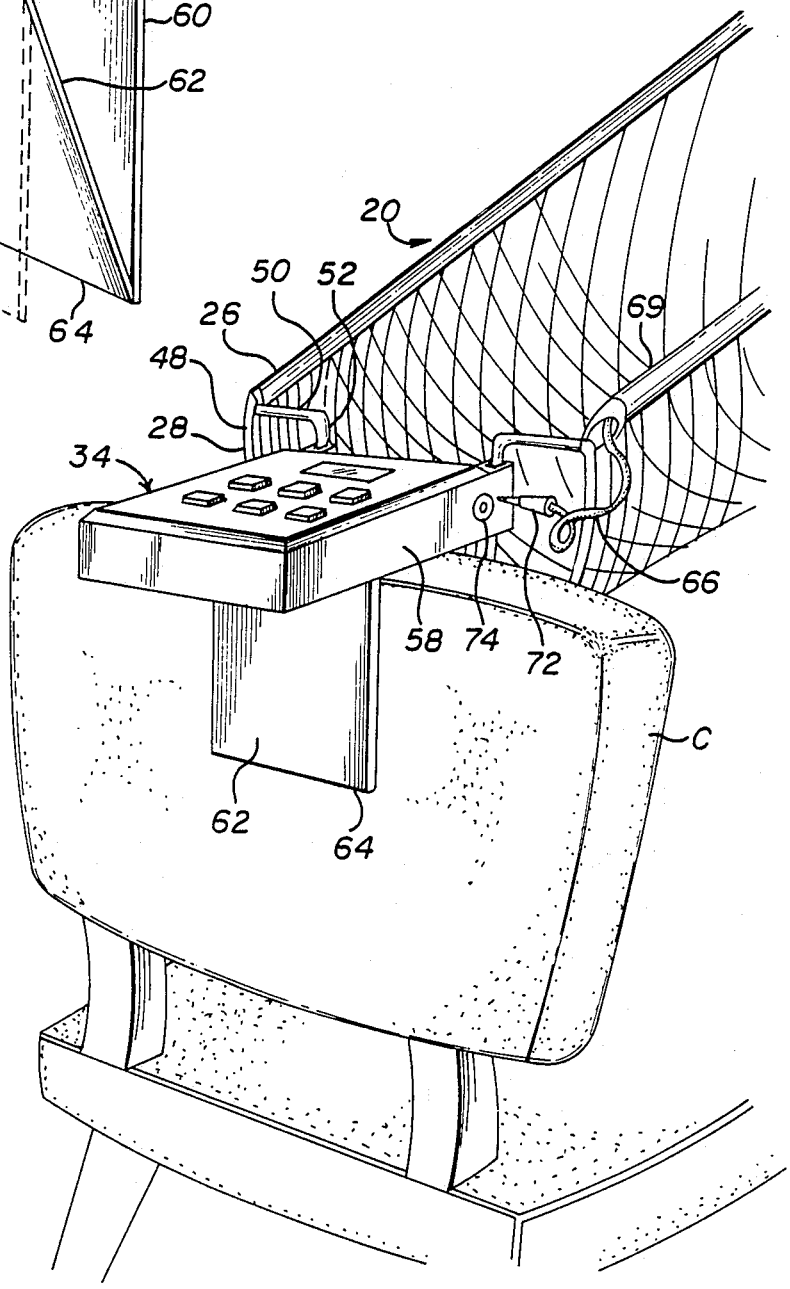
FIG. 7 is a schematic view of the lower end of the return net of FIG. 2 and the display unit, shown mounted on a chair top.

The return net 20 extends outwardly and downwardly toward the chair C where its other or lower end 26 is releasably mounted as shown in FIG. 7. The lower end 26 of the return net is secured to the second connector means 28. In particular, end 26 is connected to another generally U-shaped rod 48 in a manner similar to the first end. The second U-shaped rod 48 is smaller than rod 44, and the return net 20 is reduced in width progressing from the upper first end 22 toward the lower second end 26. This configuration produces a downwardly inclining and inwardly converging funnel or trough for the basketball. At each end of the U-shaped rod 48 there is an extension portion 50 which first extends inwardly and then extends downwardly to provide one of a pair of mounting pins 52. The pins 52 are each adapted to be releasably inserted into a generally vertical slot 54 formed in an extension 56 at a forward corner of the housing 58 for the timer unit 34. That timer housing 58 is proportioned and arranged to be mounted releasably on the top of the seatback of the chair C. In the illustrated device, the housing 58 is provided with a large "clip" structure comprised by a generally upright depending front connector section 60 and a generally upright depending rear connector section 62. The rear connector section 62 is normally biased to the position shown in solid line in FIG. 4 where its lower edge 64 is inclined forwardly toward the lower end of the front connector section 60. The section 62 is movable rearwardly against the biasing means (not shown) to a position such as shown in broken line in FIG. 8 to clip over the chair top (FIG. 7). This arrangement provides a firm and steady foundation for the timer unit 34.

It will be noted that the chair is arranged with its seat extending toward the door so as not to interfere with the player's access to the location at the net end 28 in front of the display unit 34.

The electrical cable 66 may be releasably connected as by a plug 68 at one end to a mating receptacle 70 in the score-sensor unit 30 (FIG. 2). The cable 66 may conveniently extend along one edge of the return net as by being contained within a channel or sleeve 69 formed by a side edge strip of the net that is folded over and attached to itself. The lower other end of the cable 66 may be releasably connected as by a plug 72 to a mating receptacle 74 in the timer unit 34 (FIG. 7).

The apparatus lo may be constructed of various suitable materials such as molded plastic, wood, metal or the like. It has been found that for ease, simplicity and low cost, molded plastic parts are desirable for the illustrated apparatus although the backboard and basketball rim may be made of metal or wood to provide a sturdier, more durable structure. The basket net and the return net may be conveniently made from a cloth or plastic mesh.

The timer unit 34 may be battery-operated or may be operated from an electrical outlet by means of a power cord (not shown). It may include a display window 76 and various control keys 78.

The electrical timer unit 34 may utilize standard and inexpensive microprocessor chip technology to operate a timer clock that may be set by the user with the keys 78 for a particular time period and may be started to run on a descending basis. The unit 34 may also operate to count the number of times the sensor finger 32 is engaged by a basketball which successfully passes through the hoop from a specified starting time to a specified ending time. The unit 34 may also store information about the number of successful baskets in a given time period for a particular player or for multiple players. It may also store information as to past scoring of players for comparison with the player's current performance or for comparison with the performance of other players.

It will be noted that the illustrated apparatus 10 is easily and readily assembled and disassembled into small subassemblies or elements for original packaging and for storage when it is not being used. In this regard, the first level subassemblies are as follows:

the backboard and score-sensor;

the basketball hoop and net;

the return net subassembly which comprises the net itself, upper mounting U-shaped rod, the lower mounting U-shaped rod, the electrical cable, and the timer and control unit.

Further breakdown is possible, particularly for original packaging and shipment. For example, the return net, U-shaped rods, half-sections of the upper U-shaped rod, support bracket for the upper rod, and the electrical cable may all or to some lesser extent be provided separately for initial assembly together.

Various modifications and changes may be made in the details of the illustrated structure without departing from the spirit and scope of the present invention as set forth in the claims.

We claim:

1. An inexpensive basketball play apparatus for use in the home in combination with a door and a household article such as a chair, said apparatus comprising:

(a) a basketball hoop;

(b) support means connected to the hoop and proportioned and arranged to releasable connect to the top of a door to support the hoop adjacent to the top of the door; and (c) a return net assembly including:

i) an elongated net having a width defined by opposed side edges for catching a basketball after it is shot at the basket and returning it to the shooter, ii) a first net connector means attached to one end of the net and proportioned and arranged to releasably connect to the top of the door supporting the hoop to position that one end of the net so as to at least partially enclose the area around the basketball hoop, and iii) a second net connector means attached to the other end of the net and proported and arranged to releasably connect to a household article such as the top of a chairback to position that other end of the net spaced below and away from the basketball hoop, said first net connector means comprising means for supporting the upper end of the return net at a plurality of points along its width so as to form that end in a generally trough-like configuration that extends above at both sides and also extends below the basketball hoop, said second net connector means comprising means for holding the lower end of the return net at a plurality of points along its width so as to form that end in a generally trough-like configuration whereby the assembled return net provides a generally outwardly and downwardly extending channel for the basketball, said second net connector means being constructed and arranged to be releasably clipped to the household article such as the top of a chairback, said second net connector means comprising a pair of opposed sections adapted to be positioned at opposite sides of the household article and to press inwardly against the household article to maintain the lower end of the return net in position.

2. The basketball play apparatus of claim 1 wherein said apparatus further comprises sensing means to sense and report baskets made by the basketball successfully passing through the hoop.

3. The basketball play apparatus of claim 2 wherein said sensing and reporting means includes a movable finger disposed below the basketball hoop.

4. The basketball play apparatus of claim 2 wherein said sensing and reporting means comprises an electrical arrangement which includes a sensor unit mounted adjacent to the basketball hoop and a display unit mounted at the chair, said apparatus further including an electrical cable connecting said sensor unit and said display unit.

5. The basketball play apparatus of claim 4 wherein said sensing and reporting means comprises an inexpensive microprocessor chip for receiving the sensed information and for actuating a display of such information at the display unit.

6. The basketball play apparatus of claim 4 wherein said display unit is mounted on said second net connector means.

7. The basketball play apparatus of claim 5 wherein said second net connector means includes a generally rigid netholding member, said apparatus also including means detachably connecting said net-holding member to said display unit.

8. The basketball play apparatus of claim 7 wherein said apparatus further includes first electrical connection means for detachably connecting one end of said electrical cable to said sensing unit and second electrical connection means for detachably connecting the other end of said electrical cable to said display unit.

9. The basketball play apparatus of claim 1 wherein said first net connector means comprises a generally U-shaped element for supporting the upper end of the return net in a generally trough-like configuration that extends above at both sides and also extends below the basketball hoop.

10. The basketball play apparatus of claim 9 wherein said second net connector means comprises a generally U-shaped element for holding the lower end of the return net in a generally trough-like configuration whereby the assembled return net provides a generally outwardly and downwardly extending channel for the basketball.

11. The basketball play apparatus of claim 10 wherein said generally U-shaped element of the second net connector means is smaller than the generally U-shaped element of the first net connector means, and wherein said return net is reduced in width progressing from the first net connector means toward the second net connector means.

12. An inexpensive basketball play apparatus for use in the home, said apparatus being adapted for releasable assembly to and for use in combination with a household door and a household article such as a chair, whereby the structure required for said apparatus is greatly reduced relative to what would be required for a self-standing apparatus of comparable size, said apparatus comprising:

(a) a basketball hoop;

(b) support means connected to the hoop and proportioned and arranged to releasably connect to the top of a door to support the hoop adjacent to the top of the door;

(c) a return net assembly including;

(i) an elongated net for catching the basketball after it is shot at the basket and returning it to the shooter, (ii) a first net connector means attached to one end of the net and proportioned and arranged to releasably connect to the top of the door supporting the hoop to position that one end of the net to extend a substantial distance above at both sides and also below the basketball hoop, said first net connector means comprising a first generally U-shaped, generally rigid elongated member for supporting said one end of the net in a generally U-shaped configuration, and (iii) a second net connector means attached to the other end of the net and proportioned and arranged to releasably connect to the top of household article such as a chairback to position that other end of the net space below and away from the basketball hoop, said second connector means including a second generally U-shaped, generally rigid member for holding said other lower end of the net in a generally U-shaped configuration so that the assembled return net provides a generally trough-like channel; and (d) electrical sensing and display means for sensing when a basketball passes through the hoop and displaying information that is so sensed, said sensing and display means including a sensing unit located adjacent to the basketball hoop and a display unit mounted at the chair and connected to the sensing unit to receive and display information as to the baskets scored, said second net connector means being constructed and arranged to be releasably clipped to the household article such as the top of a chairback, said second net connector means comprising a pair of opposed sections adapted to be positioned at opposite sides of the household article and to press inwardly against the household article to maintain the lower end of the return net in position.

13. The basketball play apparatus of claim 12 wherein said first U-shaped member has opposed ends and said opposed ends extend a substantial distance above the top of the door to maintain the sides of the return net one end at even a more substantial distance above the hoop.

14. An inexpensive basketball play apparatus for use in the home, said apparatus being adapted for releasable assembly to and for use in combination with a household door and a household article such as a chair, whereby the structure required for said apparatus is greatly reduced relative to what would be required for a self-standing apparatus of comparable size, said apparatus comprising:

(a) a basketball hoop;

(b) support means connected to the hoop and proportioned and arranged to releasably connect to the top of a door to support the hoop adjacent to the top of the door;

(c) a return net assembly including;

(i) an elongated net for catching the basketball after it is shot at the basket and returning it to the shooter, (ii) a first net connector means attached to one end of the net and proportioned and arranged to releasably connect to the top of the door supporting the hoop to position that one end of the net to extend a substantial distance above at both sides and also below the basketball hoop, said first net connector means comprising a first generally U-shaped, generally rigid elongated member for supporting said one end of the net in a generally U-shaped configuration, and (iii) a second net connector means attached to the other end of the net and proportioned and arranged to releasably connect to the top of a household article such as a chairback to position that other end of the net spaced below and away from the basketball hoop, said second connector means including a second generally U-shaped, generally rigid member for holding said other lower end of the net in a generally U-shaped configuration so that the assembled return net provides a generally trough-like channel; and (d) electrical sensing and display means for sensing when a basketball passes through the hoop and displaying information that is so sensed, said sensing and display means including a sensing unit located adjacent to the basketball hoop and a display unit mounted at the article and connected to the sensing unit to receive and display information as to the baskets scored, said basketball play apparatus further comprising an elongated electrical cord that extends along the return net, first electrical connection means at one end of said cord for detachably connecting to the sensing unit and second electrical connection means at the other end of said cord for detachably connecting to the display unit, said display unit being releasably mounted on the article and said generally rigid member of the second net connector means being detachably connected to the display unit, whereby the return net assembly comprising the return net, the two generally U-shaped members and the electrical cord may be disconnected from the display unit for transportation, storage and the like.

15. The basketball play apparatus of claim 14 wherein said display unit comprises an inexpensive microprocessor chip for receiving sensed information and providing the display of that information at the display unit.

16. The basketball play apparatus of claim 14 wherein said first U-shaped member is comprised of a plurality of releasably connected sections.

* * * * *